United States Patent [19]

Vegh

[11] Patent Number: 4,750,794

[45] Date of Patent: Jun. 14, 1988

[54] SLIDE-FITTED ARTICLE OF FURNITURE

[75] Inventor: William Vegh, Tempe, Ariz.

[73] Assignee: Bass Cabinet Manufacturing, Inc., Mesa, Ariz.

[21] Appl. No.: 673,840

[22] Filed: Nov. 21, 1984

[51] Int. Cl.[4] ..... A47B 45/00

[52] U.S. Cl. ..... 312/263; 312/257 R; 312/195

[58] Field of Search.....312/111, 195, 256, 257 R, 312/263, 140; 217/43 R, 12

[56] References Cited

U.S. PATENT DOCUMENTS

| | | | |
|---|---|---|---|
| 653,514 | 7/1900 | Kasschau | 217/12 R |
| 1,507,042 | 9/1924 | Binkley | 217/12 R |
| 2,112,498 | 3/1938 | Lax | 312/263 |
| 2,318,921 | 5/1943 | Bullard | 312/257 R |
| 3,033,635 | 5/1962 | Glass | 312/256 |
| 3,159,438 | 12/1964 | Carlson et al. | 312/256 |
| 3,268,284 | 8/1966 | Branciforte | 312/263 |
| 3,347,610 | 10/1967 | Pilliod | 312/263 |
| 3,379,483 | 4/1968 | Oldford | 312/257 R |
| 3,851,936 | 12/1974 | Muller | 312/111 |
| 3,874,753 | 4/1975 | Naito et al. | 312/263 |
| 4,021,087 | 5/1977 | Ferguson | 312/263 |
| 4,466,675 | 8/1984 | Ferdinand et al. | 312/330 R |

FOREIGN PATENT DOCUMENTS

| | | | |
|---|---|---|---|
| 745522 | 7/1964 | Canada | 312/257 R |

*Primary Examiner*—Joseph Falk

*Attorney, Agent, or Firm*—Brown, Martin, Haller & Meador

[57] ABSTRACT

A knock-down article of furniture in the form of a box-like structure, having front, back, and first and second sides and at least one shelf member, is assembled by means of an arrangement of interconnecting tenon tongues and elongated mortise grooves in intersecting planes to cause the parts of the structure to interlock together to form a rigid structure without requiring any additional fasteners.

5 Claims, 3 Drawing Sheets

FIG. 1
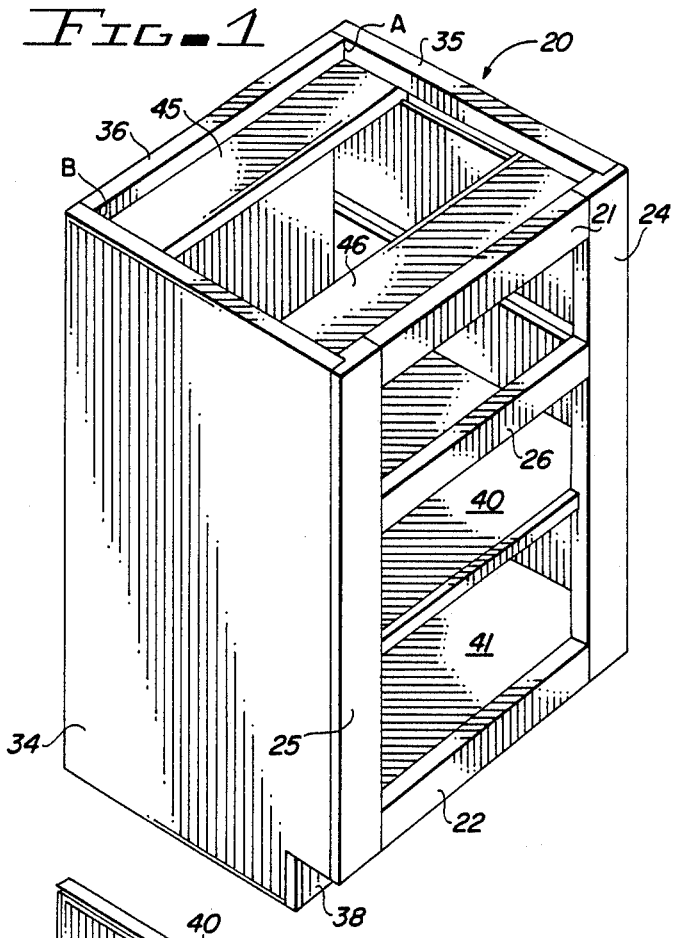
FIG. 2
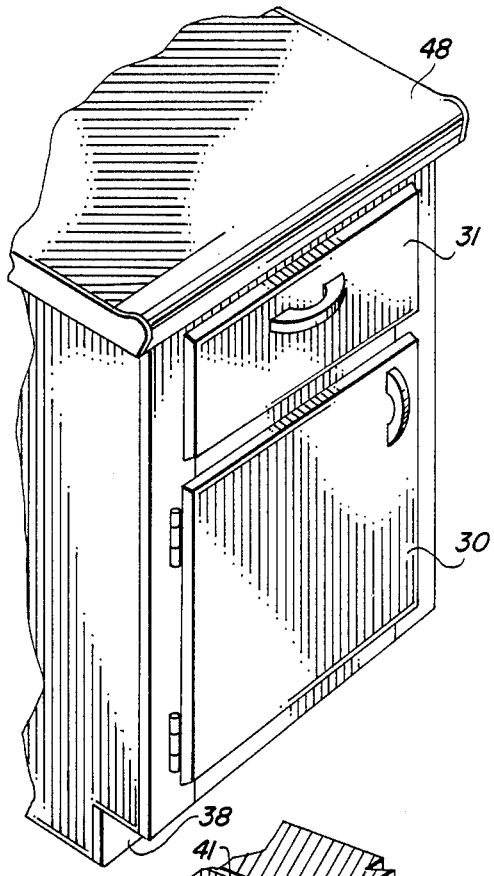
FIG. 6
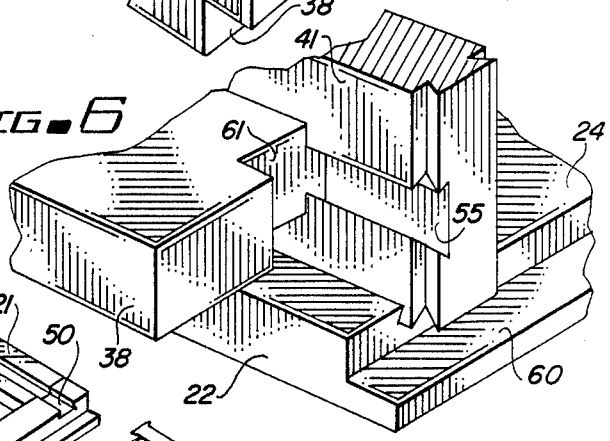
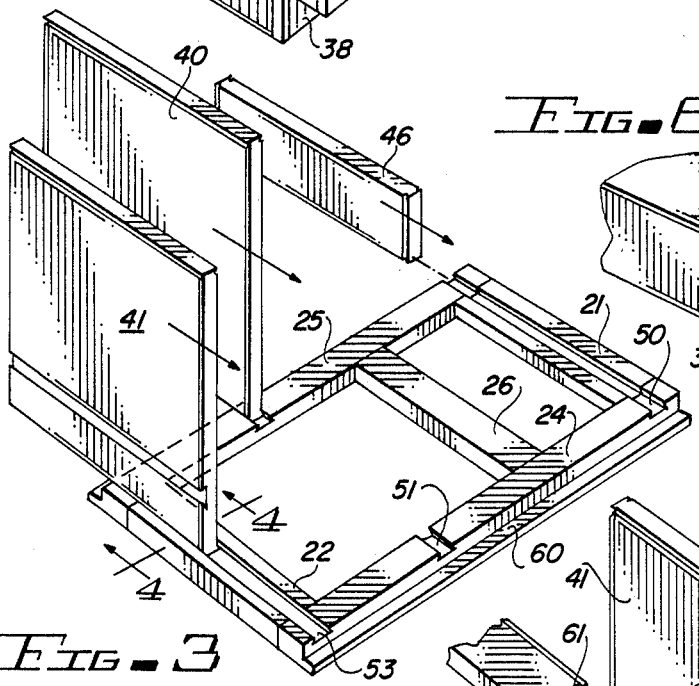
FIG. 3
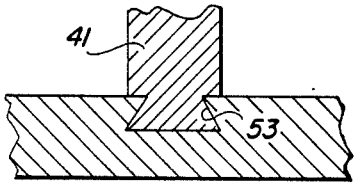
FIG. 4
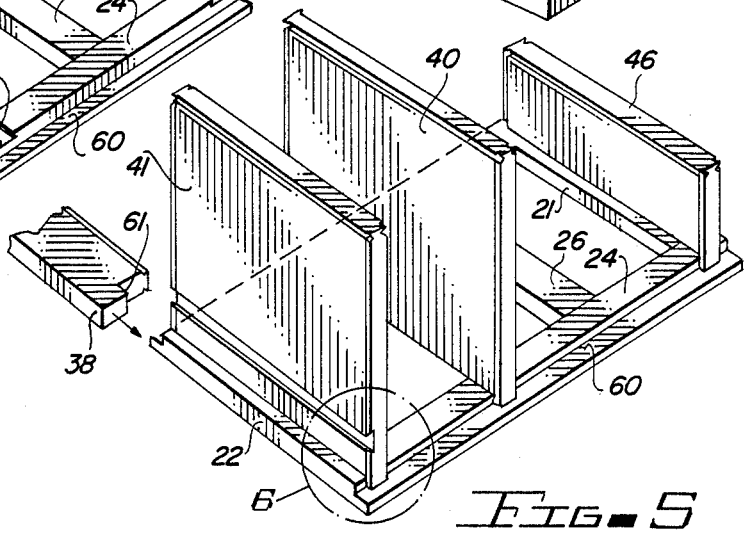
FIG. 5

SLIDE-FITTED ARTICLE OF FURNITURE

BACKGROUND OF THE INVENTION

Furniture and cabinet manufacturing typically involves a substantial amount of labor-intensive work in the cutting, shaping and assembly of the articles of furniture. This is true even of box-like furniture items such as desks, chests and cabinets, such as bathroom vanities and upper and lower kitchen cabinets. Generally, such items of furniture are fully assembled at the factory. This results in a relatively bulky structure which requires substantial space for shipping.

Assembly of cabinets or desk pedestals and the like typically requires the use of nails, screws, glue, glue blocks or other fasteners to assure the integral strength and rigidity of the finished article. Final assembly of furniture and cabinets using fasteners of these types requires substantial amounts of labor and materials. This is true even for mass production kitchen cabinet manufacturing plants which utilize many standard or interchangeable parts, assembly jigs, and semi-automatic tools.

Since kitchen cabinets and bathroom vanities typically are pre-assembled at a factory and then are shipped to the building site for installation, an additional problem arises in protecting these cabinets and vanities from damage during shipping. Such rectangular cabinets are particularly susceptible to damage from stress applied unevenly to sides or corners of the cabinets. This can cause glue joints to break and distortion of the cabinets in amounts sufficient to cause binding or sticking of drawers or improper fit of doors when such cabinets are later installed at the job site. The potential for damage of this type during shipping is very high; and the repair of cabinets which have been even only slightly misaligned due to shock during shipment, adds substantially to labor time and cost of the completed project. In addition, because of the substantial bulk of pre-assembled cabinets, the shipping space required to ship, for example, a full kitchen or the like, is substantial. Consequently, trucks used for this purpose by cabinet manufacturers and contractors generally are mid-sized or heavy-duty trucks even though the total weight of the load is not particularly high for the volume of space which is required.

Although it may be possible to ship the component parts of conventional modular kitchen cabinets to a job site in a disassembled form, the necessary jigs for maintaining alignment of the various parts during assembly usually are not available at the job site, and such jigs are too cumbersome for use by installers at the job site. In addition, a substantial amount of expensive skilled labor would be required for the nailing and gluing of conventional cabinets if they were to be assembled at the job site.

Consequently, it is desirable to overcome the disadvantages of shipping pre-assembled kitchen cabinets and the like to a job site. If possible, it is preferable to ship the component parts in a knocked-down condition since all of the parts of such cabinets comprise flat sheets of material. In addition, it is desirable to construct the component parts of a kitchen cabinet which can be readily and accurately assembled at a job site without requiring additional fasteners such as nails, screws, glue or the like and without requiring any special jigs or tools.

SUMMARY OF THE INVENTION

Accordingly, it is an object of this invention to provide an improved article of furniture.

It is an additional object of this invention to provide an improved modular article of furniture.

It is another object of this invention to provide an improved knock-down article of furniture.

It is a further object of this invention to provide am improved knock-down article of furniture which may be assembled in a structurally rigid finished condition without special tools.

It is yet another object of this invention to provide an improved knock-down article of furniture utilizing slide-together parts with interlocking dovetail joints to rigidly lock together all of the components thereof without the necessity of additional fasteners.

In accordance with a preferred embodiment of this invention, a knock-down article of furniture includes a flat rectangular front member, first and second rectangular side members and at least one rectangular shelf member. Two spaced-apart elongated mortise grooves parallel to one edge of the front member are formed on its inner surface. The first and second rectangular side members each also have corresponding facing first elongated mortise grooves parallel to the horizontal edges of those side members and formed on the facing inner surfaces. The rectangular shelf member has first and second opposite edges formed as elongated flaring tenon tongues dimensioned for snug slidable fit in the grooves of the first and second side members. The structure is completed by providing either the front edges of the first and second side members or the front edge of the shelf member as an elongated flaring tenon tongue dimensioned for snug slidable fit in the elongated mortise grooves in the front member; so that by sliding the tenon tongues into the corresponding mortise grooves, all of the parts are rigidly interconnected together.

BRIEF DESCRIPTION OF THE DRAWINGS

FIG. 1 is a perspective view of the assembled components of a preferred embodiment of this invention;

FIG. 2 is a partial perspective view of the embodiment shown in FIG. 1 with a top, a door and a drawer in place as a finished cabinet or vanity;

FIG. 3 illustrates details of some of the components of the embodiment of FIG. 1 as they are assembled in a first assembly step;

FIG. 4 shows a detail of the structural features of the components of FIG. 3 taken along the line 4—4 of FIG. 3;

FIG. 5 shows the components of FIG. 3 in their partially assembled form and further illustrates an additional assembly step;

FIG. 6 shows a detail of the structure of FIG. 5;

DETAILED DESCRIPTION

Figures 7, 8, 9, 10:
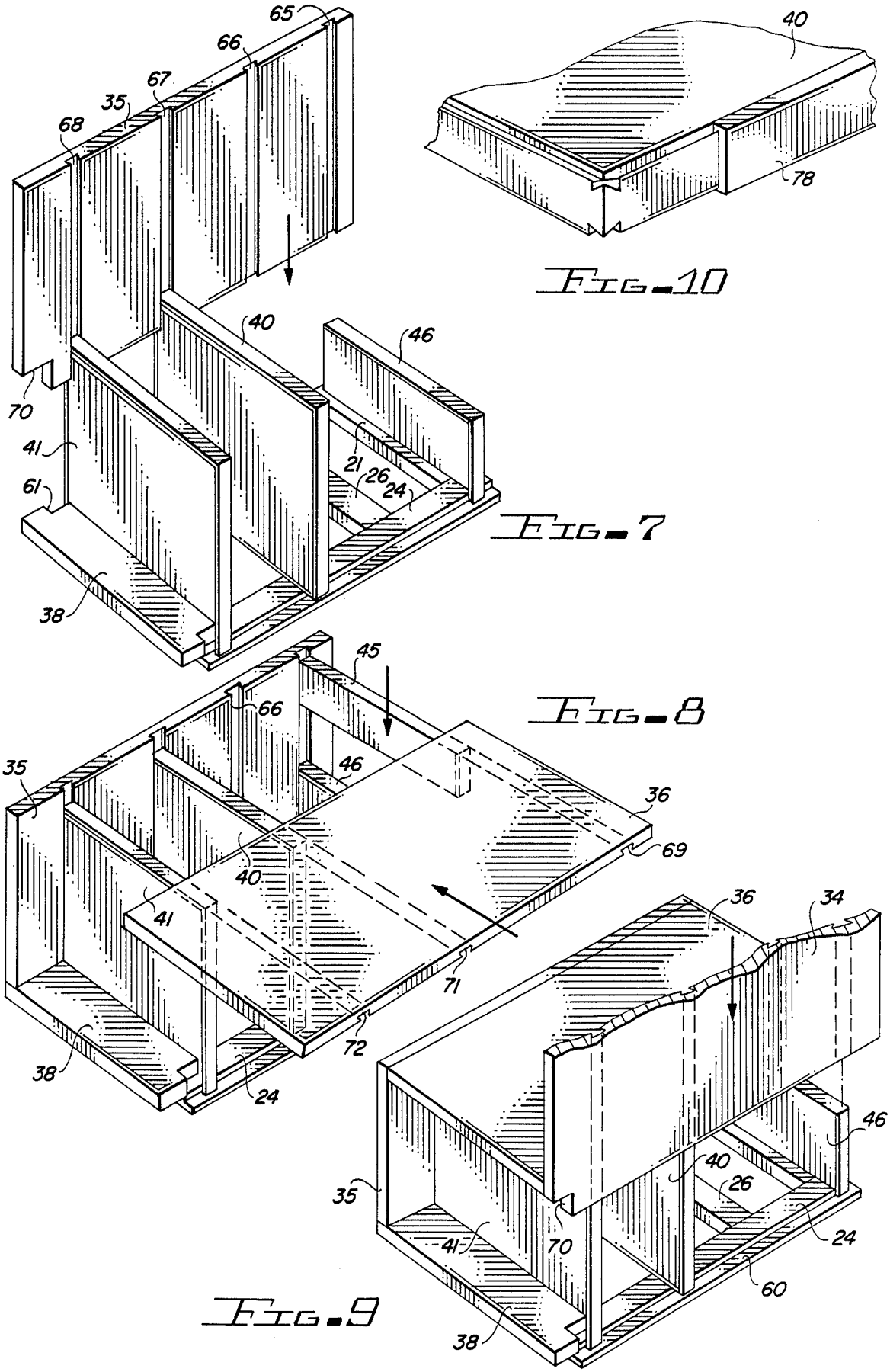
FIGS. 7, 8 and 9 show further assembly steps to form the embodiment of FIG. 1 and illustrate structural details of other components of the embodiment of FIG. 1.
FIG. 10 shows a detail of the structure for finishing a shelf edge.

Reference now should be made to the drawings in which the same reference numbers are used throughout the different Figures to designate the same or similar components. In FIG. 1 a typical "lower" kitchen cabinet 20 is shown. The finished appearance of the cabinet 20, when made in accordance with the preferred embodiment of this invention, is similar to cabinets constructed by conventional techniques. The manner of assembly of the cabinet 20 of FIG. 1 however differs considerably from standard techniques which require additional fasteners or glue or a combination of both.

The cabinet 20 includes a front panel member which is illustrated as having upper and lower cross members 21 and 22 interconnected by a pair of vertical side members 24 and 25. A short distance from the upper cross member 21 is another intermediate cross member 26. The space between the lower member 22 and the cross member 26 is of the type typically closed by a door (such as the door 30 shown in FIG. 2) whereas the opening between the members 21 and 26 is usually utilized to hold a drawer, such as the drawer 31 of FIG. 2.

The cabinet 20 includes a pair of mirror-image opposing sides 34 and 35 and a back 36. Thus, the front comprising the horizontal and vertical members 21, 22, 24 and 25 along with the sides 34 and 35 and the back 36 form an upstanding open-ended vertical box. The basic structure described thus far may be used for either an upper or a lower kitchen cabinet or other articles of furniture. As shown in FIG. 1, however, the cabinet is a lower kitchen cabinet with a kick-plate offset below the horizontal member 22 for accomodating a recessed kick-plate 38 in a standard manner. A shelf 40 is placed mid-way between the members 22 and 26 in the front of the cabinet; and the bottom of the cabinet just above the kick-plate 38 has a shelf 41 in it.

At the top of the cabinet 20, just below the plane of the upper surface of the front back and side members, a pair of partial shelves 45 and 46 are provided. Shelf 45 is interconnected with the sides 34 and 35 and the back 36, while the shelf 46 is interconnected with the sides 34 and 35 and the upper horizontal member 21 of the front of the cabinet. The space between the shelves 45 and 46 typically is used (for a bottom kitchen cabinet) to accomodate a sink and plumbing in a conventional manner. If a sink is not located in this area, the top simply is covered with a counter top, such as the top 48 shown in FIG. 2.

The cabinet as illustrated in FIGS. 1 and 2 looks like a conventional kitchen cabinet. The manner of its assembly, however, differs considerably from standard assembly techniques which use nails, staples, screws, or glue, or a combination of such fasteners, to hold the cabinet together.

Because of its unique manner of assembly, a kitchen cabinet, vanity, desk pedestal, cupboard, storage chest, or the like, constructed in general as illustrated in FIG. 1 and 2, may be pre-cut and then shipped to the construction site or customer in a knocked-down configuration in the form of a compact package of stacked flat rectangular pieces. Consequently, storage and shipping costs can be reduced considerably. It is possible to haul all of the cabinets, in a knocked-down state, for a relatively large house or commercial establishment, in a station wagon or pick-up truck. This is to be contrasted with the necessity for using large vans in the past to transport preassembled cabinets of such a nature to the job site.

A structurally rigid cabinet of the type illustrated in FIGS. 1 and 2 is assembled in accordance with the steps, procedures and components illustrated in FIGS. 3 through 9. These figures show the step-by-step assembly of a cabinet of the type shown in FIG. 1. To begin assembly, the front comprising the vertical side members 24 and 25 and the upper, intermediate, and lower cross-members 21, 26, and 22, respectively, is laid on a flat surface on its outer face. This is illustrated most clearly in FIG. 3. As can be seen in FIG. 3, three horizontal dove-tailed mortise grooves 50, 51, and 53, are formed parallel with the members 21, 26, and 22, across the inner or back surface of the front of the cabinet. A detail of the groove 53 is shown in FIG. 4. This same dove-tail structure on an elongated groove extending entirely across the inner face of the panel is used for each of the grooves 50 and 51, and for similar grooves in other panels, as described subsequently.

The two shelves 40 and 41 are formed with dove-tail flaring tenon tongues along all four edges. A detail of the tongue on one edge of the shelf 41, as it engages the grooves 53, is shown in FIG. 4. A similar configuration exists on all four edges of the shelf 40 and on the lower left and right edges of the partial shelf 46 as it is viewed in FIG. 3. Each of these shelves are slid lengthwise into engagement with the respective grooves 50, 51, and 53 in the direction of the arrows, as illustrated in FIG. 3. The shelves then are moved in the direction of those arrows to the position shown in FIG. 5. A detail of a corner of the engagement of the shelf 41 with the groove 53 in the member 22 is shown in FIG. 6.

It also is apparent from an examination of FIGS. 3, 5, and 6 that each of the vertical members 24 and 25 of the front have an offset step 60 formed along their edges. These offsets extend throughout the length of the members 24 and 25 for accommodating the front edges of the sides 35 and 34, respectively; so that the width of the reduced thickness portion of the offset 60 is chosen to be the same as the thickness of the sides 34 and 35.

As examination of FIG. 6 shows the intersecting crossed flaring tenon tongues on two perpendicular edges of the shelf 41. As explained previously, the shelves 40 and 41 have these tongues on all four edges to permit the sliding interconnection of the various parts of the cabinet.

The kickplate 38 has a notched offset 61 on each of its ends, and the offset on the end overlying the inner side of the member 24 is illustrated in FIG. 5. The upper edge of the kick-plate 38 if formed as a flaring tenon tongue for sliding insertion (as shown in FIG. 5) into a corresponding mortise groove 55 on the lower surface of the shelf 41.

Each of the sides 34 and 35 have four parallel matching dove-tail mortise grooves 65, 66, 67 and 68, formed across them in parallel with the upper and lower edges (horizontal in the installed cabinet) of the sides 35 and 36. For the side 35, this is shown most clearly in FIG. 7. After the subassembly shown in FIG. 5 has been completed, the next step is to slide one or the other of the sides 35 and 36 into place. This is accomplished by sliding the side 35 over the dove-tail flaring tenon edges of the shelves 40, 41, and 46 in the direction of the arrow, as illustrated in FIG. 7.

It should be noted that for the structure being described, the groove 66 does not have any shelf in it. This groove, however, is used in the subsequent construction of the cabinet to serve as a mounting groove for the slides for the drawer 31 shown in FIG. 2. Alternatively, an additional shelf, similar to the shelves 40 and 41, also could be placed in the groove 66, if desired. If such an additional shelf were to be used, corresponding horizontal grooves would be formed across the member 26 and the vertical members 24 and 25 of the front, in parallel with the grooves 50, 51, and 53 described previously.

Once the side 35 is in place in the position shown in FIG. 8, a notch 70 on its front edge interlocks with the corresponding notch 61 on the left edge (as viewed in FIG. 7) of the kickplate 68 to hold the kickplate in place so that it cannot slide outwardly toward the left past the side member 35. The lower edge of the side 35 is seated in the offset 60 on the vertical member 25 of the front to abut tightly against the rear offset side of the member 25. When the side 35 is in place, the upper edge, as viewed in FIG. 7, which actually becomes the rear edge of the side 35 in the finished cabinet, extends beyond the upper edges of the shelves 40 and 41 by an amount sufficient to accomodate the thickness of the back 36 of the cabinet.

The back 36 has parallel horizontal dove-tail mortise grooves 69, 71, and 72 cut across it in parallel with its upper and lower edges (as finally assembled) alignment with the corresponding grooves 65, 67, and 68 of the sides 34 and 35. Once the side 35 is in place, the partial shelf 45 is slid downwardly in the groove 65 in the direction of the vertical arrow shown in FIG. 8 to the position shown in FIG. 8. Then the back 36 is slid into place in the direction of the arrow from right to left, as viewed in FIG. 8, to engage the dovetail flaring tenon tongues on the edges of the shelves 45, 40, and 41, respectively, in the dove-tail mortise grooves 69, 71, and 72. In the assembled position, the leftmost edge (as viewed in FIGS. 8 and 9) of the back 36 abuts snugly against the inner side of the side member 35, as shown in FIG. 9.

As is apparent from an examination of FIG. 9, the width of the back 36 is less than the outside measurement across the front at the outer edges of the vertical members 24 and 25 by an amount equal to the combined thickness of the side members 34 and 35. Consequently, the flaring tenon dove-tail tongues of the final remaining exposed edges of the shelves 40, 41, 45, and 46 extend just slightly beyond the right-hand edge (as viewed in FIGS. 8 and 9) of the back 36 when it is in position.

The next step then is to slide the final side 34 into place by an interengagement of the mortise grooves 65, 67, and 68 with the exposed edges of the shelves 45/46, 40 and 41, respectively, until the lower edge (as viewed in FIG. 9) of the side 34 abuts snugly against the offset 60 on the rear side surface of the member 24. Once again, the offset 70 for the kickplate interlocks with the right-hand end of the kickplate 38 to prevent movement of the kickplate 38 toward the right, as viewed in FIG. 9, once the side 34 is fully in place.

The assembly just described requires no fasteners of any type to hold it together. When it is attached by means of any suitable fasteners through the back 36 to a wall, all of the parts are rigidly held together and cannot move with respect to one another. If desired, a small staple, nail, or spot of glue may be provided at the corners A and B, where the top shelf segment 45 engages the side 35 and back 36, to prevent any possible relative movement of these parts with respect to the other portions of the assembly. If a full shelf is used at the top in place of the partial shelves 45 and 46, however, even this minimal additional fastener is rendered wholly unnecessary.

The cabinet which is assembled in accordance with the illustrations of FIGS. 1 through 9 is very strong structurally. It is capable of withstanding substantial shock without any distortion or pulling apart of the various components. The different flat rectangular pieces which are assembled together to form the cabinet may be made of any suitable material presently used in the construction of cabinets, vanities, and other articles of furniture such as chests and desks. Such materials include, but are not limited to, particle board, various types of plywood, and solid soft woods and hard woods.

Since the structure which has been described in conjunction with FIGS. 1 through 9 includes shelves, such as the shelf 40, with flaring tenon tongues on all four edges, an exposed edge, such as the edge of the shelf 40, which is behind the door 30, needs to be treated cosmetically for its most pleasing appearance. This can be accomplished by placing an edge trim 78 in the exposed portion of the flaring tenon tongue which is located between the edges of the vertical side members 24 and 25 of the front of the cabinet when the door 30 is opened. Various types of commercially available snap-on trim pieces 78 may be used as the edge trim 78. Preferably, the trim 78 is placed over the edge of the shelf 40 (and any other similar exposed shelf edges) after the cabinet is assembled in the manner described previously.

Reference now should be made to FIGS. 11 through 16, which illustrate an alternative embodiment of the invention, useful as an article of furniture such as a desk pedestal, which is intended to be free-standing, as opposed to the cabinet shown in FIGS. 1 through 10, which is intended to be placed against or attached to a vertical wall surface. Since the sides 34 and 35 of the cabinet 20 of FIGS. 1 through 9 are capable of sliding movement of the rear of the cabinet if it is free-standing, a different arrangement of the dove-tail mortise grooves and flaring tenon tongues must be made for a free-standing structure. The arrangement of FIGS. 1 through 9, however, is preferred for wall-mounted cabinets, since the wall surface on which the cabinet is mounted prevents rearward movement of the sides 34 and 35, once the assembled cabinet is placed against and attached to the wall.

In the embodiment of FIG. 11 through 16, however, some slight modifications are made within the overall concept of a knock-down slide-together dove-tail construction. These differences are indicated most clearly in the top view of FIG. 11, which is a partially cut-away view looking downwardly onto the top of a cabinet showing the upper edges of the front, side and back members. Components in the embodiment of FIGS. 11 through 16 which are comparable to corresponding components of the embodiment of FIGS. 1 through 9 are given the same reference numbers, but with a one hundred (100) series numbering being used. For example, the side member 134 of FIGS. 11 through 16 is comparable in function to the side 34 of FIG. 1, and the back 136 of the embodiment shown in FIGS. 11 through 16 is comparable to the back 36 of the embodiment of FIGS. 1 through 9. Other similar number combinations are used, as in readily apparent from an examination of the various figures of the drawings.

Figure 11:
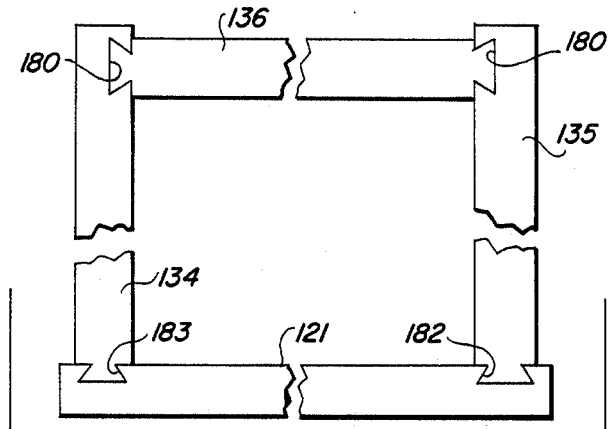
FIGS. 11 through 15 illustrate details of an alternative embodiment of the invention.
Figure 14:
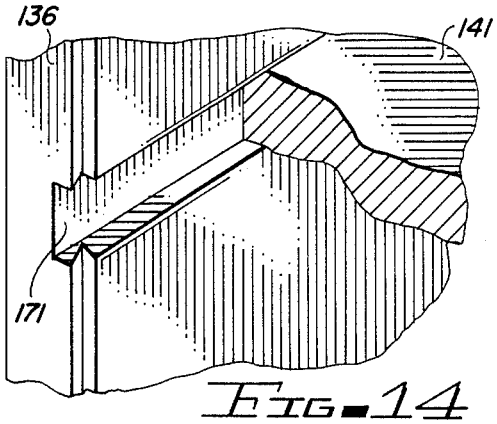
Figure 12:
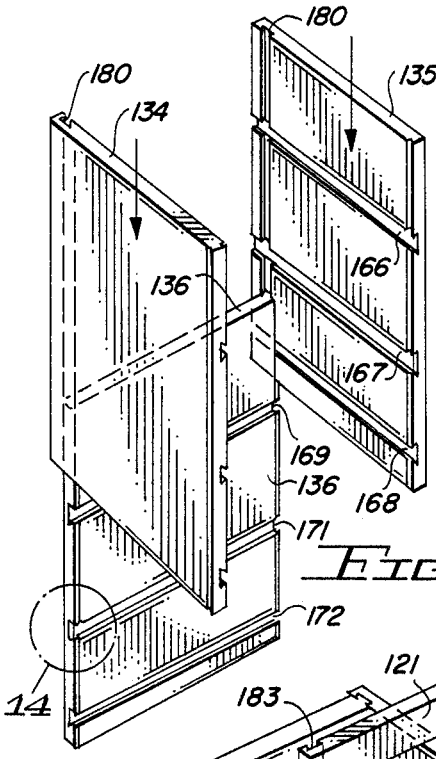
Figure 13:
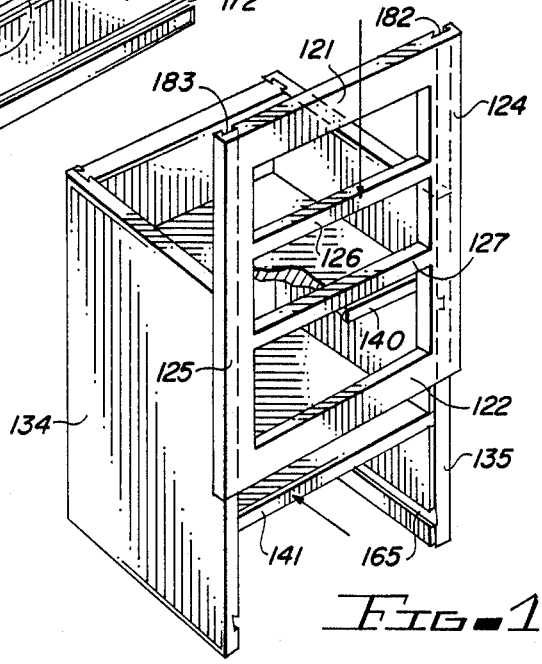

One of the primary differences between the two embodiments is most readily apparent from an examination of FIGS. 11, 12, and 13. This is the provision of vertical mortise dove-tail grooves in the rear or inner surfaces of the members 124 and 125 of the front of the cabinet, in place of the horizontal mortise grooves 50, 51, and 53 illustrated in the embodiment of FIGS. 1 through 9. Similarly, vertical mortise grooves 180 are formed a slight distance inwardly from the rear edge of the sides 134 and 135. All of these grooves are shown clearly in the top view of FIG. 11. Corresponding flaring tenon tongues then are formed on both of the vertical edges of the back 136 and on the forward vertical edges of the sides 134 and 135 for snug slidable fit in the corresponding grooves 180, 182, and 183. These fit is illustrated in FIG. 11.

The side members 134 and 135 have horizontal mortise dove-tail grooves 166, 167, and 168 cut through them on their inner surfaces parallel to the horizontal upper and lower edges of the side members. Similarly, the back has grooves 170, 171, and 172 which correspond respectively, and are aligned with, the corresponding grooves 166, 167, and 168. The grooves 170, 171, and 172 in the back 136, however, are plain dado grooves, and are not dove-tail mortise grooves. These are the only plain dado grooves used in the construction, and the reason for this is apparent from the subsequent description of the assembly of the embodiment shown in FIG. 11 through 16. The details of the groove 171 in the back 136 and the manner in which that groove is engaged by the shelf 141 are shown clearly in FIG. 14.

To assemble the cabinet of FIGS. 11 through 16, the sides 134 and 136 are slid downwardly from above in the direction of the arrows (FIG. 12) over the flaring tenon tongue edges of the back 136, until the sides rest against the surface on which the back 136 is placed. After the sides are in place, shelves, such as the shelves 140 and 141 shown in FIG. 13, are slid into engagement with the corresponding grooves 166, 167, and 168 in the sides 134 and 135 through the front from right to left (as shown in FIG. 13). The opposite edges of the shelves 140 and 141 which engage the mortise grooves 166, 167 or 168 are in the form of flaring tenon tongues of the type described previously in conjunction with shelves 40 and 41. The front and back edges of the shelves 140 and 141, however, may be plain and do not need to be in the shape of flaring tenons for the structure shown in FIGS. 11 through 16. The rear edge of the shelves 140 and 141 seat within the corresponding plain dado grooves 170 and 171, in the back 136, as illustrated most clearly in the detail of FIG. 14.

Figure 15:
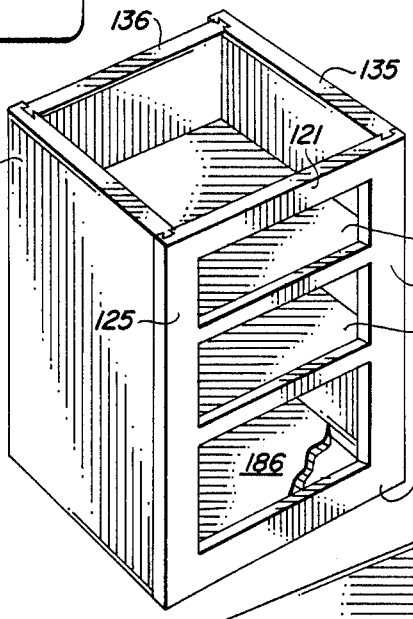

Once the shelves are in place, the front is slid downwardly over the forward edges of the sides 134 and 135 by engaging the flaring tenon front edges of the sides 134 and 135 in the mortise grooves 183 and 182, respectively, until the front is in place in the position shown in FIG. 15. Since the shelves 140 and 141 hold the back 136 in position, as shown in FIG. 15, so that it cannot move in any direction, and since the shelves also interlock the two sides 134 and 135 with one another and the back 136, the only piece which still is free for movement vertically with respect to the others is the front, comprised of the members 124, 125, 121, and 122.

Figure 16:
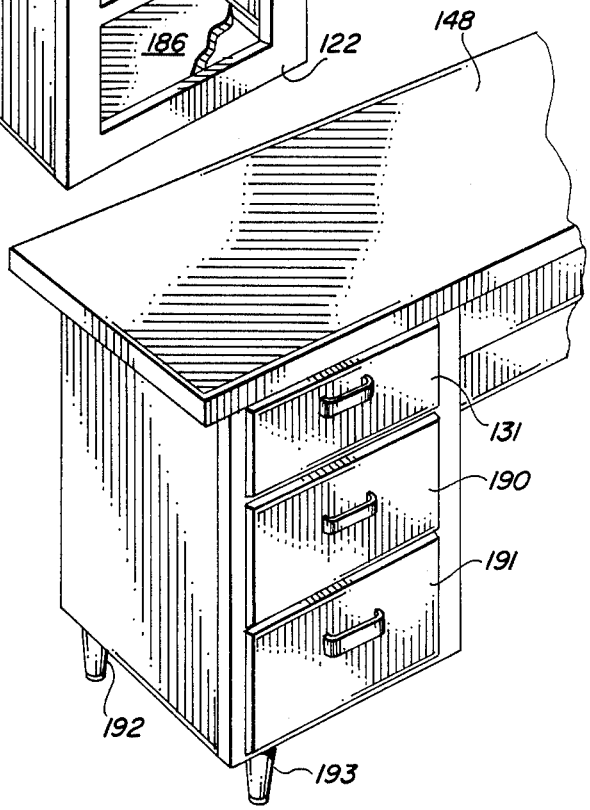
FIG. 16 shows utilization of the embodiment of FIGS. 11 through 15 as a desk pedestal.

To prevent the front 122 from dropping downwardly, an offset may be cut horizontally in the lower edge of the inner side of the member 122 to engage a slightly extending lip in a lower shelf 186 (FIG. 15), which is placed in the grooves 168 at the bottom of the sides 134 and 135. This forward extension of the shelf 186 then underlies the offset (which is similar to the offset 60 shown in the vertical side members 24 and 25 of the embodiment of FIGS. 1 through 9) to limit the downward movement or position of the front of the cabinet. This front then still is capable of movement upward in the subassembly shown in FIG. 15. When a desktop or the like, such as the top 148 shown in FIG. 16, is attached in a conventional manner to the pedestal formed from the subassembly shown in FIG. 15, however, all of the parts are interlocked together without requiring any additional fasteners to hold them firmly in place. The desk pedestal then may be completed by inserting standard drawers 131, 190, and 191, and by attaching legs, if desired, such as the legs 192 and 193, shown in FIG. 16.

Various other applications of structures of the type shown in the two embodiments described above may be developed by those skilled in the art, other than the cabinets and desk pedestals which have been described above. The foregoing description and the embodiments illustrated in the drawings are to be considered as illustrative only of the invention, using parts interlocked by mortise grooves and flaring tenon tongues in intersecting planes, and not as limiting. Various changes and modifications will occur to those skilled in the art without departing from the true scope of the invention. The particular cross-sectional shape of the dove-tail joints which have been used in a standard configuration, and other types of elongated male and female dove-tail interconnecting parts may be used, if desired.

What is claimed is:

1. A knockdown cabinet assembly, comprising:

at least six interengaging panels, including front, rear and side panels of flat rectangular shape defining an open-ended cavity, the panels having opposed inner surfaces, and each having opposite upper and lower edges and opposite side edges, and upper and lower flat rectangular panels extending parallel to the open ends of the cavity and having dimensions no less than the open ends of the cavity;

each panel having spaced interlocking means for slidably connecting the panel with corresponding interlocking means on at least two other panels of the assembly;

the interlocking means each comprising a flared tenon tongue extending along a respective panel edge and a corresponding dovetail mortise groove extending along an inner surface of the panel, the maximum thickness at the outer end of each tenon tongue being greater than the minimum thickness at the opening of each mortise groove by an amount sufficient to prevent the tongue from moving transversely into or out of the groove;

the upper and lower panels each having flared tenon tongues extending along all four edges and the front, rear and side panels having corresponding horizontal spaced dovetail mortise grooves extending along their inner surfaces parallel to their upper and lower edges for slidably receiving the respective front, rear and side edge tenon tongues of the upper and lower panels;

the front panel having indents on its inner face of width substantially equal to the thickness of the side panels, the indents extending alongside the side edges of the front panel for receiving the front side edges of the side panels when the side panels and front panel are interlocked with the upper and lower members; and the width of the rear panel measured in a direction parallel to its upper and lower edges being less than the corresponding width dimension of the front panel by an amount substantially corresponding to the combined thickness of the side panels.

2. The assembly as claimed in claim 1, wherein the length of the front and rear edges of the upper and lower panels is greater than the length of the the mortise grooves in the the front and rear panels by an amount substantially equal to the combined height of the tenon tongues in the side edges of the upper and lower panels to allow the side tongues to project for engagement in the grooves in the side panels when the upper and lower panels are interlocked with the front and rear panels.

3. The assembly as claimed in claim 2, wherein the width of the side panels measured in a direction parallel with the upper and lower edges of the panels is greater than the length of the side edges of the upper and lower panels by an amount substantially corresponding to the thickness of the rear panel minus the depth of the mortise grooves in the rear panel so that the rear, outer face of the rear panel is flush with the rear edges of the side panels when the article is assembled.

4. The article as claimed in claim 1, wherein the upper and lower panels comprise shelf panels.

5. A knock down article of furniture, comprising:

spaced front, rear and side panels each of flat rectangular shape, and spaced upper and lower panels interengaging with said front, rear and side panels to form a box-like cavity;

the upper and lower panels each having flared tenon tongues extending along all four edges and the front, rear and side panels each having corresponding, horizontal spaced dovetail mortise grooves extending along their inner surfaces, the respective front, rear and side edge tongues of the upper and lower members being slidably received in the corresponding mortise grooves of the front, rear and side panels, the transverse thickness of the outer end of each tenon tongue being greater than the transverse thickness of the opening of each dovetail groove by an amount sufficient to prevent movement of the tongue transversely into or out of the groove;

the front panel being wider in a dimension parallel with its mortise grooves than the corresponding width dimension of the rear panel by an amount substantially equal to the combined thickness of the side panel and having vertical indents each of thickness equal to a respective side panel thickness on its inner face adjacent its side edges, the front edges of the side panels being received in said indents with their outer faces flush with the outer side edges of the front panel;

the lower panel having a dovetail mortise groove extending along its lower face parallel to its front edge; and a kickplate having a flaring tenon tongue extending along its upper edge, the tongue being slidably engaged in said mortise groove in the lower face of the lower panel;

the kickplate having an upwardly facing indent in each of its outer side edges, and each of the side panels having corresponding, downwardly facing notches at their front edges which are engaged over the indents at each side edge of the kickplate to hold it in place.

* * * * *